US006135068A

United States Patent [19]

Sampo

[11] Patent Number: 6,135,068

[45] Date of Patent: Oct. 24, 2000

[54] METHOD FOR ABSORBING THE VIBRATION OF A FREE-PISTON ENGINE AND VIBRATION-ABSORBED FREE-PISTON ENGINE

[75] Inventor: Matti Sampo, Turenki, Finland

[73] Assignee: Sampower Oy, Hameenlinna, Finland

[21] Appl. No.: 08/507,986

[22] Filed: Jul. 27, 1995

[51] Int. Cl.[7] ..... F02B 71/00

[52] U.S. Cl. ..... 123/46 B

[58] Field of Search ..... 123/46 R, 46 B, 123/55.5, 55.7, 192.1

[56] References Cited

U.S. PATENT DOCUMENTS 3,391,680 7/1968 Benson .
3,432,088 3/1969 Steiger .
4,649,886 3/1987 Igashira et al. .

FOREIGN PATENT DOCUMENTS 694 221 A1 6/1940 Germany .
1809 465 9/1970 Germany .

OTHER PUBLICATIONS

Japanese Abstract JP A 62–7967, vol. 11, No. 175, M–596. (Jan. 1987).

*Primary Examiner*—Thomas N. Moulis
*Attorney, Agent, or Firm*—Royston, Rayzor, Vickery, Novak & Druce, L.L.P.

[57] ABSTRACT

The invention relates to a method for absorbing the vibration of a five-piston engine and to a vibration-absorbed five-piston engine. At least two separate piston units are synchronized to operate in a counter action such that a certain position of one piston unit actuates forcibly and simultaneously the operation of fuel pumps and injection nozzles intended for the two piston units. Operation of the fuel pumps can be effected mechanically by means of the actions of the piston unit.

8 Claims, 2 Drawing Sheets

11
12
12
11

11
12
12
11

25
21 (23)
22(24)
28
26
7

METHOD FOR ABSORBING THE VIBRATION OF A FREE-PISTON ENGINE AND VIBRATION-ABSORBED FREE-PISTON ENGINE

The present invention relates to a method for absorbing the vibration of a free-piston engine, said method including a step of synchronizing at least two separate piston units to operate in a counter action such that the piston units travel in the opposite directions.

The invention relates also to a vibration-absorbed free-piston engine, comprising at least two separate piston units synchronized to operate in a counter action such that the first and second piston units travel in the opposite directions.

This type of method and engine are disclosed in U.S. Pat. No. 3,432,088. In this prior known free-piston engine, the synchronization of different piston units is based on using the position of one piston unit for controlling the timing of the ignition spark for both piston units. The fuel supply of each piston unit is controlled on the basis of the stroke of that particular piston unit. This prior known arrangement is not adaptable to a free-piston engine, which operates on the diesel principle and wherein the fuel supply is effected by injection.

An object of the invention is to provide a vibration-absorbed free-piston engine, wherein the absorption of vibration is carried out by the timing of fuel injection A vibration absorption method of the invention can be performed by simple mechanical arrangements. At the same time it is possible to realize the supply of driving force to fuel pumps and the timing of injection in such a manner that the oppositely phased operation of piston units is secured in all operating conditions.

The characterizing features of the invention are set forth in the annexed claims.

A few embodiments of the invention will now be described in more detail with reference made to the accompanying drawings, in which FIG. 1 shows a schematic longitudinal section of a free-piston engine which is vibration absorbed according to the invention;

Figure 1:
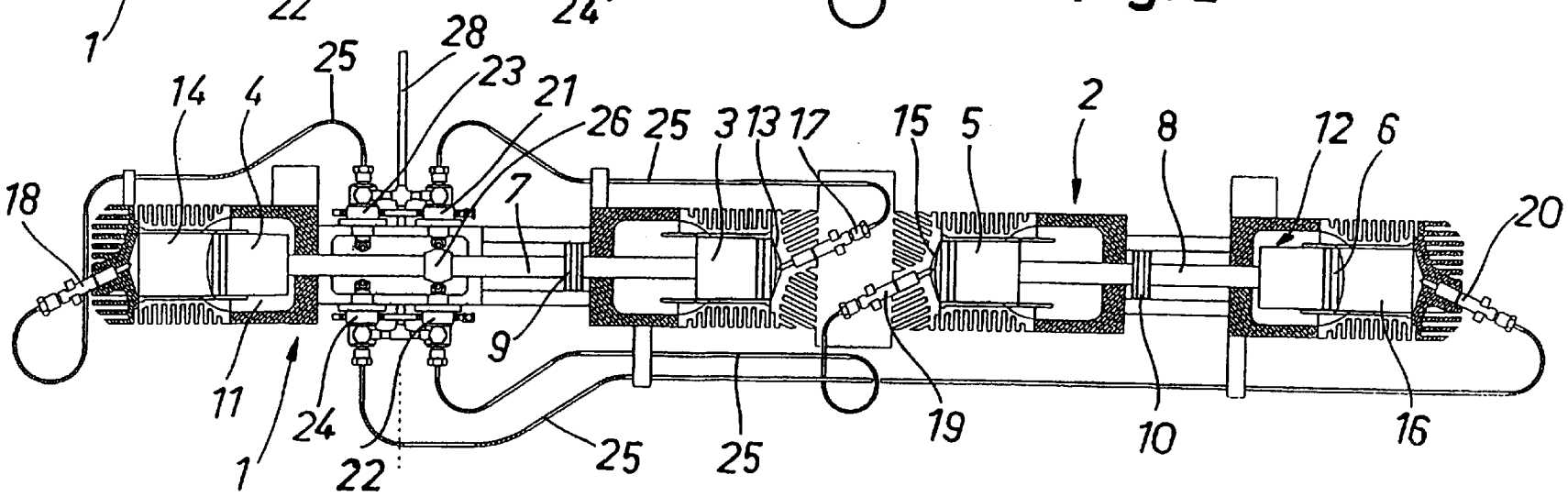

In the case of FIG. 1, two engine units 1 and 2 are set in axial succession and coupled mechanically to each other or to a common housing. The engine unit 1 includes a piston unit 11, comprising pistons 3, 4 mounted on the opposite ends of a piston rod 7. Respectively, the engine unit 2 includes a piston unit 12, comprising pistons 5, 6 mounted on the opposite ends of a piston rod 8. Pistons 9 and 10 fastened to piston rods 7 and 8 produce hydraulic power, as described in the applicant's U.S. Pat. No. 5,123,245.

The rod 7 of piston unit 11 carries a cam element 26, comprising at least two adjacent cam surfaces (located axially in line with each other) for effecting the simultaneous operation of fuel pumps 21 and 22. The pump 21 connects with a hose 25 to an injection nozzle 17 for injecting fuel into a cylinder space 13 included in the piston 3 of piston unit 11. The fuel pump 22 connects with a hose 25 to an injection nozzle 19 for injecting fuel into a cylinder space 15 included in the piston 5 of piston unit 12. Since the injection-of fuel occurs exactly simultaneously, the combustion in cylinder spaces 13 and 15 also proceeds simultaneously and, thus, the action of piston units 11 and 12 in the opposite directions commences simultaneously.

As the cam surfaces of said cam element 26 lift the pumping elements of fuel pumps 23 and 24, the injection of fuel from nozzles 18 and 20 proceeds simultaneously into cylinder spaces 14 and 16. This mode of operation makes sure that the oppositely directed action of piston units 11 and 12 will be forcibly synchronized even in the case that the engine units 1 and 2 are loaded in a different fashion.

The supply of fuel to fuel pumps 21–24 is effected by way of a common tube 28. Naturally, it is possible to replace the separate pumps 21 and 22 by a single pump, whereby the supply of fuel to nozzles 17 and 19 would be effected by way of a branched supply hose 25. However, the commercially available pumps and nozzles are dimensioned in a manner such that a single pump is adapted to supply a single nozzle.

Figure 2:
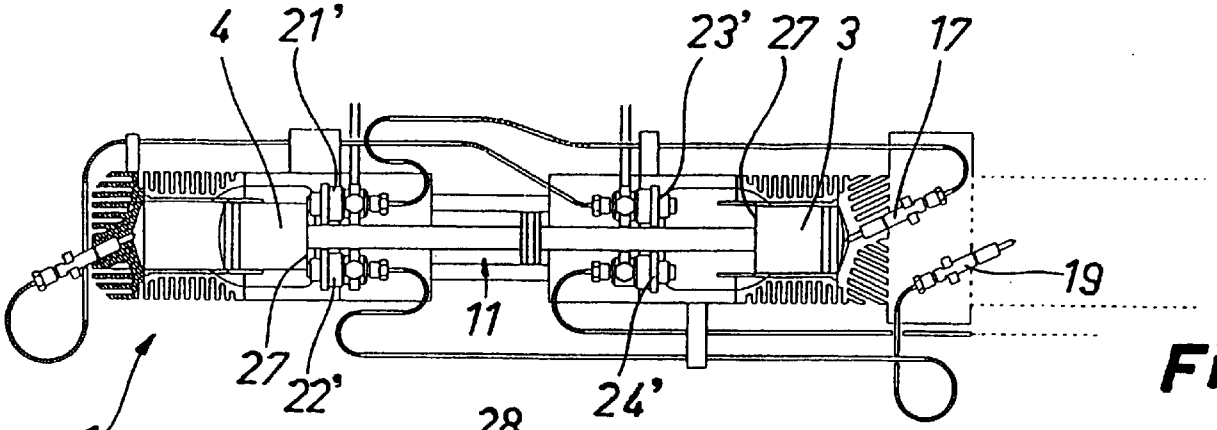
FIG. 2 shows an alternative embodiment for a free-piston engine which otherwise corresponds to FIG. 1 except that the fuel pumps, operated radially in FIG. 1, are mounted to be operated axially.

In FIG. 2, the arrangement of fuel pumps 21'–24' is such that the action of the pumping elements thereof proceeds in the axial direction. In the illustrated case, the skirts of pistons 3 and 4 included in piston unit 11 provide counter-surfaces 27, each of which strikes in turn against the cams of pumps 21', 22' or 23', 24' for effecting pumping strokes.

It is possible to replace mechanical fuel pumps by electrically operated pumps, wherein the pumping stroke is effected magnetically. Thus, the timing of the action of pumps is carried out accordingly, but the mechanical impulses indicating the position of piston unit. 11 are replaced by electrical impulses.

Figures 3, 3A, 4, 4A, 5:
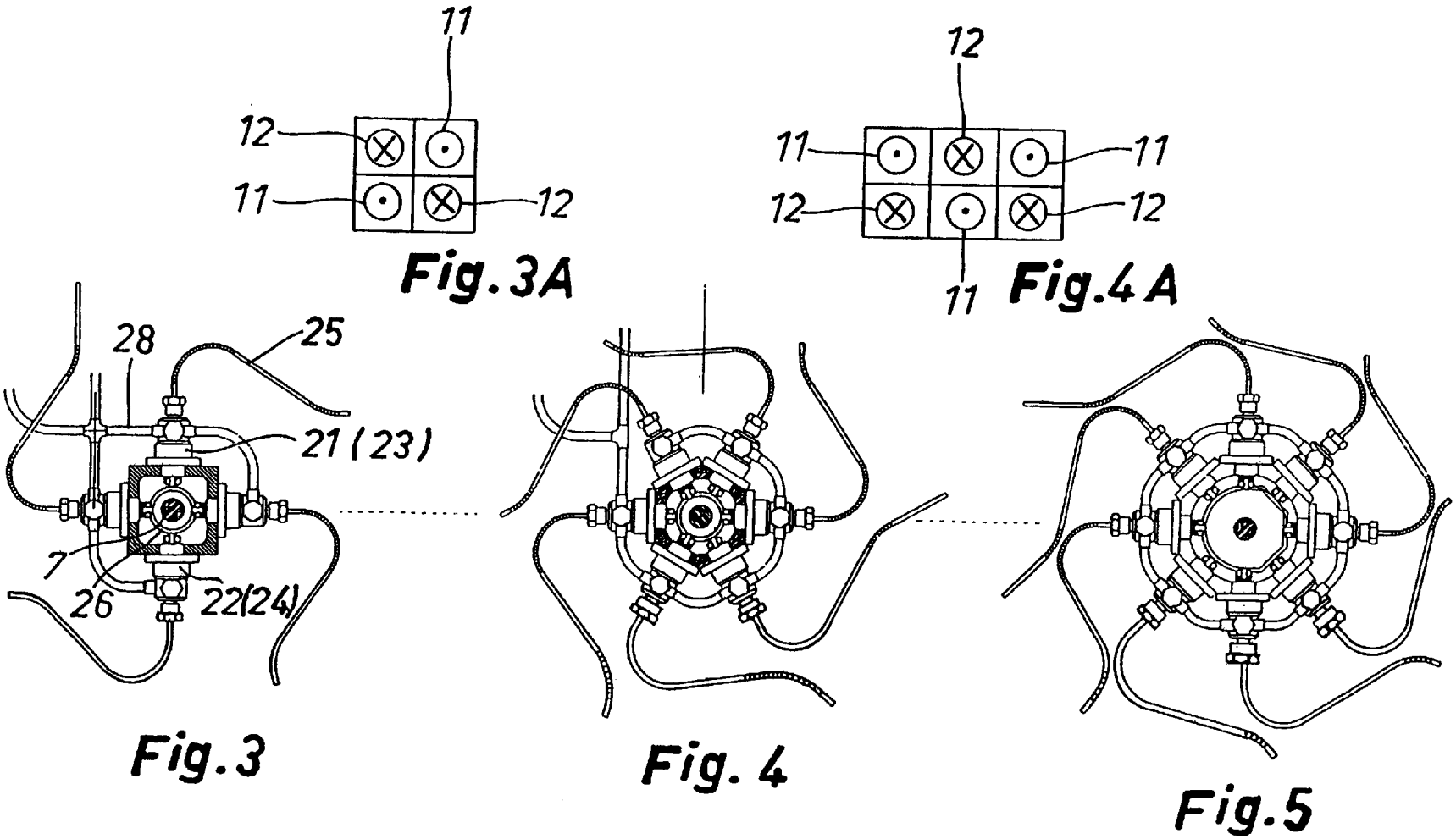
FIG. 3 shows a cross-section of a piston unit, provided with fuel pumps for the fuel injection of four different piston units.
FIG. 4 shows a cross-section of a piston unit, provided with fuel pumps for the fuel injection of six different piston units.
FIG. 5 shows a cross-section of a piston unit, provided with fuel pumps for the fuel injection of eight different piston units.

In the cases of FIGS. 1 and 2, the fuel pumps 21, 23 (21'. 23') intended for piston unit 11 are positioned in the axial direction at a distance from each-.other, said distance corresponding to the optimum stroke of piston unit 11. The same applies to the disposition of fuel pumps 22 and 24 intended for engine unit 2. Thus, the fuel pumps intended for individual piston units 11, 12 will be positioned side by side along a periphery encircling the piston rod 7. The number of these parallel units can be increased as the number of piston units increases This is illustrated in FIGS. 3, 4 and 5. When the number of piston units 11, 12 is four or an even number higher than that, it is also possible to create a completely vibration-absorbed free-piston engine by mounting the engine units side by side In this case, the disposition can be selected such that the moments of masses traveling in the opposite directions neutralize each other (see FIGS. 3A and 4A). Naturally, the movable piston units must have masses that are equal to each other.

The invention is not limited to the above exemplary embodiment. For example, a free-piston engine can be of such a type that in each engine unit a single engine piston divides the cylinder into two combustion chambers, said combustion chambers encircling the piston rods.

I claim:

1. A method for absorbing the vibration of a free-piston engine, said method including a step of synchronizing at least two separate piston units to operate in a counter action such that the piston units travel in the opposite directions, characterized in that fuel injection nozzles for each piston unit are operated by means of injection pumps, the timing of the operation thereof being determined on the basis of the position of one and the same piston unit.

2. A method as set forth in claim 1, characterized in that the fuel injection pumps for each piston unit operating in a counter action are operated mechanically by means of the actions of one and the same piston unit.

3. A vibration-absorbed free-piston engine, comprising at least two separate piston units synchronized to operate in a counter action such that the first and second piston units travel in the opposite directions, characterized in that the fuel injection nozzles for the first piston unit and the fuel injection nozzles for the second piston unit are connected to fuel pumps, the timing of the operation thereof being adapted to be controlled on the basis of the position of said first piston unit.

4. A free-piston engine as set forth in claim 3, characterized in that said fuel pumps receive their mechanical drive through the actions of said first piston unit.

5. A free-piston engine as set forth in claim 4, characterized in that cam surfaces carried along with said first piston unit are adapted to mechanically operate the radially positioned fuel pumps.

6. A free-piston engine as set forth in claim 4, characterized in that counter-surfaces carried along with said first piston unit are adapted to mechanically operate the axially positioned fuel pumps.

7. A vibration-absorbed free-piston engine, comprising at least two separate piston units synchronized to operate in a counter action such that the piston units travel in the opposite directions, characterized in that a certain position of one piston unit actuates forcibly and simultaneously the operation of fuel pumps and injection nozzles intended for the two piston units (11, 12).

8. A free-piston engine as set forth in claim 7, characterized in that said one piston unit operates mechanically the fuel pumps of said two piston units.

* * * * *